US008260170B2

(12) United States Patent
Lehmann et al.

(10) Patent No.: US 8,260,170 B2
(45) Date of Patent: Sep. 4, 2012

(54) SYSTEM TO PRODUCE A LOCKING CONNECTION BETWEEN A TONER RESERVOIR AND A COVER SEALING THE TONER RESERVOIR

(75) Inventors: Manfred Lehmann, Puchheim (DE); Reinhold Schmidl, Fuerstenfeldbruck (DE); Dietrich Pensold, Wasserburg (DE)

(73) Assignee: Océ Printing Systems GmbH, Poing (DE)

( * ) Notice: Subject to any disclaimer, the term of this patent is extended or adjusted under 35 U.S.C. 154(b) by 435 days.

(21) Appl. No.: 12/578,670

(22) Filed: Oct. 14, 2009

(65) Prior Publication Data

US 2010/0092211 A1 Apr. 15, 2010

(30) Foreign Application Priority Data

Oct. 15, 2008 (DE) ..... 10 2008 051 744

(51) Int. Cl.
*G03G 15/08* (2006.01)

(52) U.S. Cl. ..... 399/106; 399/258; 399/262

(58) Field of Classification Search ..... 399/106, 399/258, 260, 262
See application file for complete search history.

(56) References Cited

U.S. PATENT DOCUMENTS

| | | | | |
|---|---|---|---|---|
| 3,610,454 | A | 10/1971 | Malick | |
| 3,659,735 | A | 5/1972 | Landen | |
| RE30,625 | E | 5/1981 | Akers | |
| 5,983,069 | A | 11/1999 | Cho et al. | |
| 6,535,697 | B2 | 3/2003 | Reihl et al. | |
| 7,382,997 | B2 * | 6/2008 | Yamada et al. | 399/106 |
| 7,433,633 | B2 * | 10/2008 | Yamada et al. | 399/258 |
| 7,711,293 | B2 * | 5/2010 | Koyama | 399/262 |

FOREIGN PATENT DOCUMENTS

| | | |
|---|---|---|
| DE | 10 2006 007 304 | 9/2007 |
| WO | WO 00/19278 | 4/2000 |

* cited by examiner

*Primary Examiner* — William J Royer
(74) *Attorney, Agent, or Firm* — Schiff Hardin LLP

(57) ABSTRACT

In a method or system to produce a locking connection between a toner reservoir and a cover sealing the toner reservoir, first and second locking units are provided that are locked with one another after sealing the toner reservoir with the cover. The first locking unit is arranged at an inside of the cover and the second locking unit is arranged on an outside of the toner reservoir. At least one of the two locking units has a run-in slope over which the other locking unit slides.

16 Claims, 13 Drawing Sheets

SYSTEM TO PRODUCE A LOCKING CONNECTION BETWEEN A TONER RESERVOIR AND A COVER SEALING THE TONER RESERVOIR

BACKGROUND

The decanting of consumable material from a container into a receptacle is particularly important in electrographic printing or copying devices. In this use case it is necessary to continuously introduce toner as a consumable material into a developer station as a receptacle. The function of such a printing or copying device is known from WO 00/19278, for example. The addition of toner into the developer station is likewise described there.

The toner is thereby stored in a toner reservoir sealed with a cover and can be poured into the developer station as needed. In order to avoid an unwanted escape of the toner from the toner reservoir, for example during transport, techniques are required via which it can be prevented that the cover can unintentionally be opened. For example, this case can occur when the toner reservoir is shaken or knocked in order to reduce the toner in the toner reservoir to a fluid state. If the toner reservoir has been placed on the developer station, due to a particular design of an arrangement of the cover and a receptacle for the cover that is arranged in the developer station the cover can be opened again in order to be able to pour the toner into the developer station. Such an arrangement is described in DE 10 2006 007 304, for example; DE 10 2006 007 304 is herewith incorporated into this disclosure.

SUMMARY

It is an object to specify a system to produce a locking connection between a toner reservoir and a cover sealing the toner reservoir such that an unwanted opening of the toner reservoir is no longer possible.

In a method or system to produce a locking connection between a toner reservoir and a cover sealing the toner reservoir, first and second locking units are provided that are locked with one another after sealing the toner reservoir with the cover. The first locking unit is arranged at an inside of the cover and the second locking unit is arranged on an outside of the toner reservoir. At least one of the two locking units has a run-in slope over which the other locking unit slides.

DESCRIPTION OF THE PREFERRED EMBODIMENTS

Figure 1:
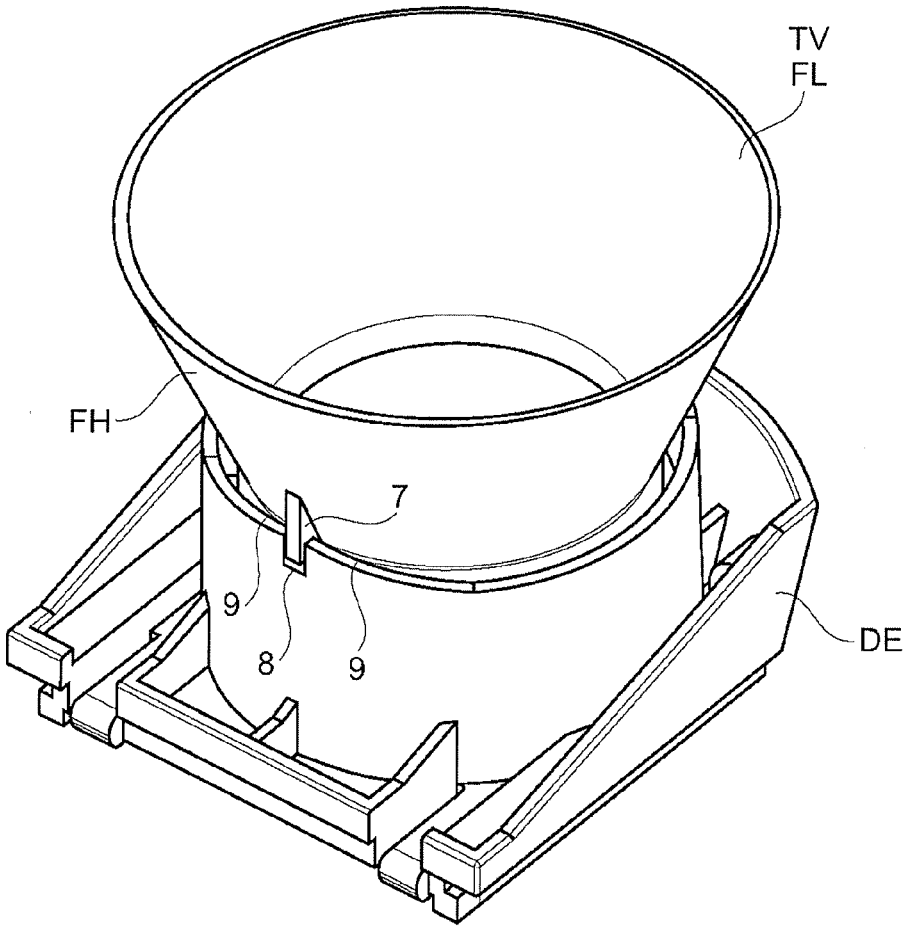
Fig. 1 (Prior Art)
FIG. 1 shows the arrangement of cover and toner reservoir according to the prior art DE 10 2006 007 304.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated devices and such further applications of the principles of the invention as illustrated as would normally occur to one skilled in the art to which the invention relates are included.

The system to produce a locking connection between a toner reservoir and a cover sealing the toner reservoir provides first and second locking units that are locked with one another after sealing the toner reservoir with the cover. The first locking unit can be arranged on the inside of the cover; and the second locking unit can be arranged on the outside of the toner reservoir. To securely catch the two locking units, at least one of the two locking units can have a run-in slope facing towards the other locking unit, over which run-in slope the other locking unit slides upon closing of the toner reservoir with the cover before the first locking unit engages in the second locking unit, wherein the run-in slope is executed such that the sliding of the other locking unit on the one locking unit is possibly only with the use of force.

In the first exemplary embodiment, at least two hooks comprised of a rigid material, having a hook neck and a hook head and arranged offset from one another can be provided as a first locking unit, the respective head of which hook respectively has the run-in slope that is aligned towards the toner reservoir and falls away towards the head end. The second locking unit can be arranged as ring sectors on the inside of the toner reservoir, wherein the number of ring sectors corresponds to the number of hooks.

If the toner reservoir should be sealed with the cover, the cover is placed on the toner reservoir, the hooks with their run-in slopes slide over the ring sectors, and these thereby deform elastically until the hook heads catch on these. The ring sectors subsequently relax again, with the result that cover and toner reservoir are firmly locked with one another.

If the toner reservoir is, for example, designed to be elastic in regions, this can elastically deform upon sliding of the hooks on the ring sectors, wherein the toner reservoir relaxes again after the engagement. A more secure locking is thereby achieved.

In order to prevent the cover from being rotated after the locking, the cover can provide a groove and the toner reservoir can provide a tongue. Upon placement of the cover on the toner reservoir, the cover is then directed such that the tongue engages in the groove. It can therefore also be ensured that the hooks impinge exactly on the ring sectors.

An additional improvement of the locking connection is achieved when the ring sectors are executed wider than the hook heads. The cover can then be rotated somewhat after placement on the toner reservoir until the tongue strikes the groove. If the cover additionally has a run-in slope on the edge before the groove, over which run-in slope the tongue must slide before it arrives at the groove, the locking connection is additionally secured.

If the ring sectors have a run-in slope parallel to the run-in slope in the direction of the hooks, the sliding of the hooks on the ring sectors is facilitated.

In order to reduce the abrasion of the hooks, the ends of the hooks can be designed blunt since these points of the hooks strike the ring sectors.

The first embodiment thus has the following advantages:

- the hooks can be designed to be large and stable since the elasticity upon engaging no longer comes from the hooks but rather from the toner reservoir or from the ring sectors;

the hooks are no longer designed acute but rather as 90° angles so that acute edges are no longer blunted as quickly;

a targeted deformation of the toner reservoir can be achieved via the run-in slopes at the hooks;

a rotation safeguard made up of tongue and groove is used for a positionally accurate association of the hooks in the circumferential direction relative to the toner reservoir, wherein the locking connection is even more secure given use of the run-in slopes at the edge of the cover adjacent to the groove; and the locking of cover and toner reservoir is designed so as to be simple.

In a second embodiment, a screw connection interrupted into thread sectors is used. At least one first thread sector on the inside of the cover is thereby provided as a first locking unit and at least one second thread sector on the outside of the toner reservoir is provided as a second locking unit, which locking units are arranged such that the one thread sector slides under the other thread sector upon rotation of the cover at the toner reservoir; and the thread sectors are designed such that both thread sectors press or compact firmly with one another upon rotation. Upon placement of the cover on the toner reservoir, the thread sectors of the cover submerge between the thread sectors of the toner reservoir; and the cover can subsequently be rotated relative to the toner reservoir.

In the second embodiment, a rotation safeguard can be achieved in that at least one tongue is arranged at the edge of the toner reservoir, and the edge of the cover has at least one groove, wherein a run-in slope rising towards the groove is provided at the cover on at least one side of the groove so that, upon rotation of the cover relative to the toner reservoir, when screwing down the tongue must slide over the run-in slope, wherein at least the tongue elastically deforms and at the end of the rotation the tongue catches in the groove and then relaxes again.

In a third embodiment, a screw connection interrupted into thread sectors is likewise used. At least one first thread sector is thereby again provided on the inside of the cover as a first locking unit and at least one second thread sector is provided as a second locking unit on the outside of the toner reservoir, which first and second locking units are arranged such that the one thread sector slides under the other thread sector upon rotation of the cover relative to the toner reservoir, and the thread sectors are designed such that two thread sectors press firmly with one another upon rotation. In contrast to the second embodiment, however, the one end of the thread sectors is designed differently. The first thread sector has at one end a catch angle situated at a distance from the cover and perpendicular to the first thread sector. The second thread sector has at one end a catch step situated perpendicular to the second thread sector. Upon rotation of the cover relative to the toner reservoir, given which the first thread sector slides below the second thread sector, at the end of the threading the catch angle is slid over the catch step and thereby engages at the catch step. A rotation safeguard corresponding to the second embodiment with groove and tongue is not required here.

The second and third embodiments thus have the following advantages:

the overlapping or coverage of the thread sectors of cover and toner reservoir is so great that the cover cannot be torn from the toner reservoir even upon elastic deformation of the toner reservoir or shaking of the cover;

a visible monitoring of the correct engagement is ensured;

a high rigidity between cover and toner reservoir is achieved via the pressing between the thread pitches of the thread sectors and the simultaneous pressing of a sealing ring (arranged in the cover, for example) into the toner reservoir;

in the third embodiment, the locking connection cannot be reached from the outside. This is thus protected against external engagement.

The preferred embodiments are explained further in the drawing figures.

A toner reservoir TV with cover DE is shown in FIG. 1; only a bottle neck FH of the toner reservoir TV is shown. The cover DE is known in terms of its essential design from DE 10 2006 007 304; there it is designated as a cover top. In the following, only the parts of cover DE and toner reservoir TV that are used in the sealing of cover DE and toner reservoir TV are described; the remaining structure of the cover DE can be learned from DE 10 2006 007 304.

The toner reservoir TV should be sealed with the cover DE; the connection of the toner reservoir TV with the cover DE must thereby be designed such that this cannot be unintentionally opened. For this a locking connection is provided that provides respective locking units at the cover DE and the toner reservoir TV that can lock with one another when the cover DE has been placed on the toner reservoir TV such that an unintentional opening is not possible, for example during transport of the toner reservoir TV.

In the following drawing figures the toner reservoir TV is designated as a bottle FL with bottle neck FH without the toner reservoir TV having to have the shape shown in the drawing figures in order to apply the preferred embodiments. In contrast to this, in the specification a toner reservoir TV is generally discussed since the toner reservoir TV does not need to have a bottle neck FH for the preferred embodiments.

Figure 2:
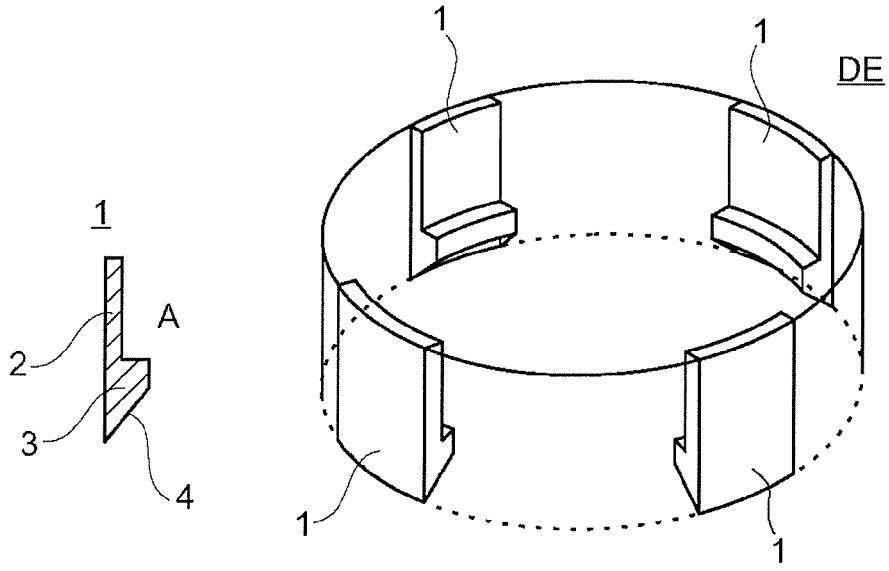
FIG. 2 is a view of a cover in a first embodiment.
Figure 3:
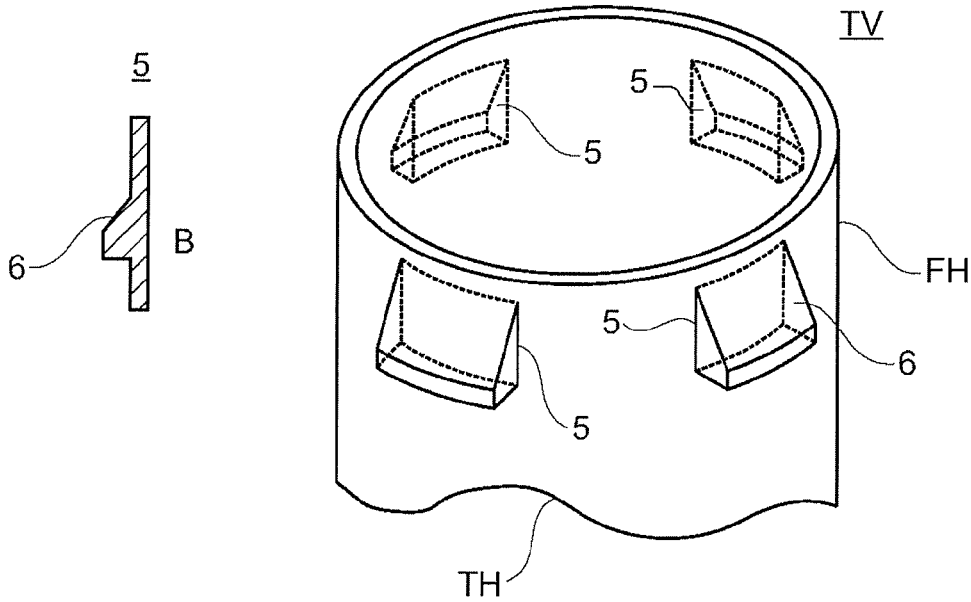
FIG. 3 is a view of a toner reservoir in the first embodiment.

A first embodiment results from FIGS. 2 and 3. Of the cover DE only a cylindrical receptacle part is thereby shown in FIG. 2, and of the toner reservoir TV only a cylindrical part (for example only the bottle neck FH) is shown in FIG. 3. Multiple hooks 1 (for example four hooks) that are uniformly distributed are arranged in the inside of the cover DE. The hooks 1 are designed to be rigid so that they do not elastically deform upon locking with a second locking unit. They have a hook neck 2 and a hook head 3 (shown next to the cover DE in the detail depiction A). The hook head 3 is designed so as to be reinforced in cross section relative to the hook neck 2, and in fact such that the hook neck 2 transitions into the hook head 3 and thereby the hook head 3 is wider in cross section, and then becomes ever narrower towards the end of the hook head 3. A run-in slope 4 thereby arises from the beginning of the hook head 3 to the end of the hook head 3.

As the second locking unit, ring sectors 5 that are distributed corresponding to the hooks 1 are arranged on the outside of the toner reservoir TV so that hooks 1 can slide over the ring sectors 5 upon placement of the cover DE on the toner reservoir TV. A representation of a section of a ring sector 5 is shown next to FIG. 3 as a view B. The ring sectors 5 can likewise be provided with run-in slopes 6 that are directed opposite to the run-in slopes 4 of the hooks 1 but whose gradient corresponds to that of the run-in slopes 4 of the hooks 1. Furthermore, the ring sectors 5 and/or the toner reservoir TV are designed so as to be at least partially elastic.

If the hooks 1 are now shifted over the ring sectors 5 to establish the locking connection, the rigidly executed hooks 1 slide over the ring sectors 5 and, with their run-in slopes 4, press the ring sectors 5 and/or the toner reservoir TV together;

these thereby deform elastically. If the hooks 1 with their hook heads 3 have been shifted over the ring sectors 5, the hook heads 3 snap onto the ring sectors 5; at the same time, the elastically deformed ring sectors 5 or the toner reservoir TV can relax again, wherein toner reservoir TV and cover DE brace so that the cover DE can no longer be removed from the toner reservoir TV without destruction.

In order to prevent a lateral rotation of the cover DE, a groove 8 can be provided on the edge of the cover DE and a tongue 7 can correspondingly be provided on the edge of the toner reservoir TV, which tongue 7 can engage in the groove 8 upon placement of the cover DE on the toner reservoir TV (FIG. 1). If the region around the groove 8 additionally has a run-in slope 9 (FIG. 1), an additional bracing can be achieved given a slight rotation that is limited by the width of the ring sectors 5 in that the tongue 7 moves onto the run-in slope 9, wherein the tongue 7 and/or the toner reservoir TV elastically deform, and in that after the engagement of the tongue 7 in the groove 8 the two can relax again.

Figure 4:
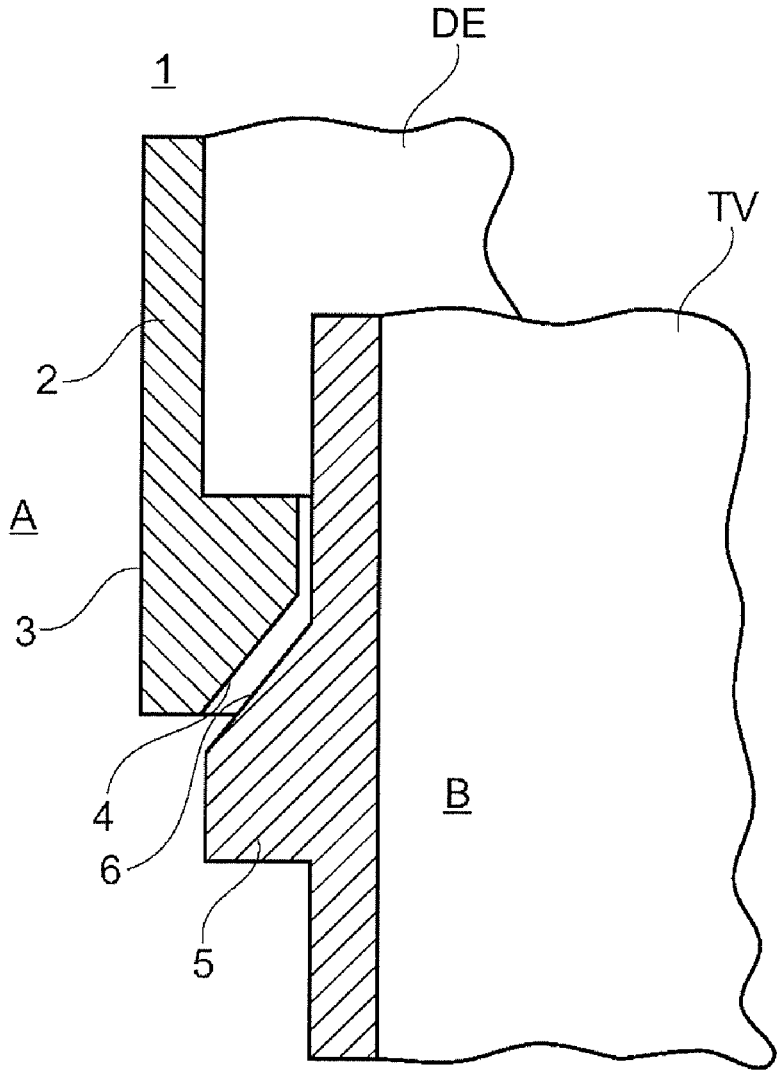
FIG. 4 is a section through a detail of a hook and the toner reservoir.

In FIG. 2 the hook head 3 is executed so as to be acute at the tip. It is more advantageous if the end and the beginning of the hook head 3 are executed to be blunt, as FIG. 4 shows this, since it is therefore prevented that the acutely executed points of the hook head 3 gradually wear down during operation. FIG. 4 shows the position of hook 1 and toner reservoir TV shortly before the locking. It is apparent that the hook head 3 is realized such that, upon pressing the hook 1 onto the ring sector 5, the hook head 3 compresses the toner reservoir TV and therefore deforms this. Only after the hook head 3 has slid over the ring sector 5 can the toner reservoir TV relax again, whereby a secure locking is achieved.

The hooks 1 can be part of the cover DE (as shown in FIG. 4); however, they can also be attached to the cover DE. The ring sectors 5 can likewise be part of the toner reservoir TV, as shown in FIG. 4.

Figure 5:
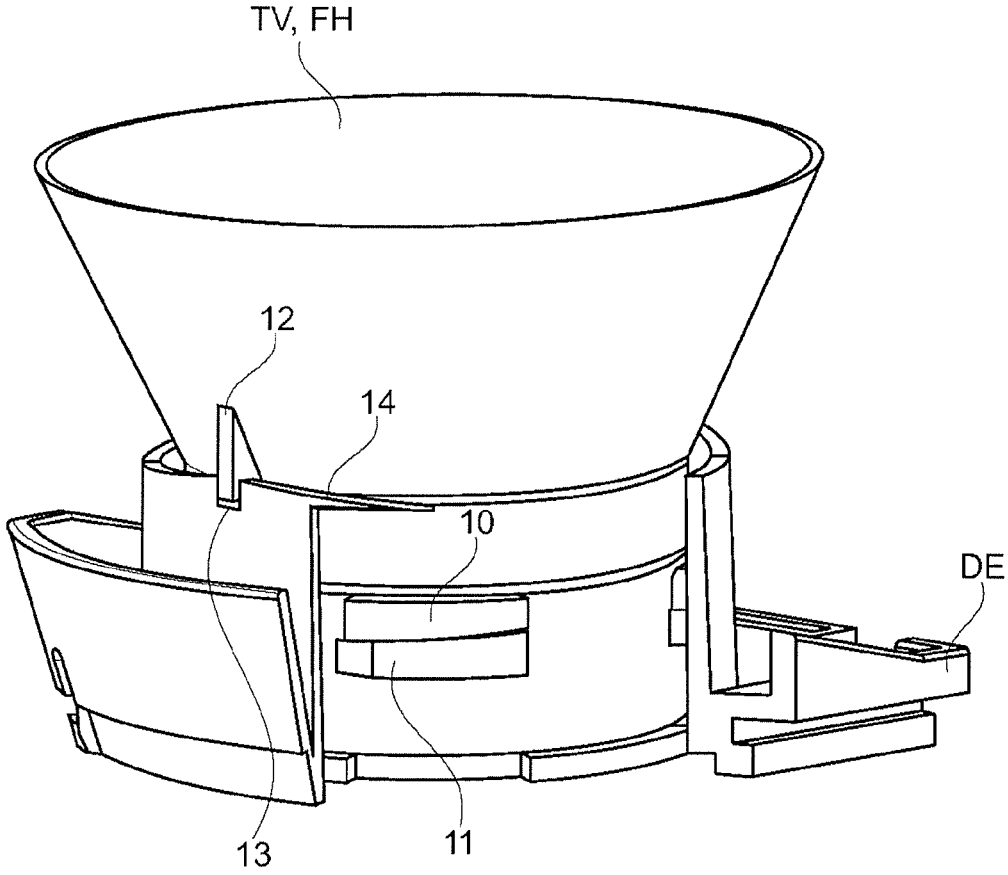
FIG. 5 is a view of a second embodiment.

FIG. 5 shows a second exemplary embodiment. In FIG. 5, the toner reservoir TV and the cover DE are shown in an arrested state. The cover DE is thereby sliced in order to make the preferred embodiment more easily recognizable. Multiple first thread sectors 10 (for example two first thread sectors 10) are arranged as first locking units at the cover DE; a corresponding number of second thread sectors 11 are arranged as second locking units at the toner reservoir TV. Upon rotation of the cover DE relative to the toner reservoir TV, the second thread sectors 11 slide under the first thread sectors 10 and press together with these. The gradient (run-in slope) of the thread sectors 10, 11 can be selected so that the two thread sectors 10, 11 firmly pressed together. In order to prevent an unscrewing of the cover DE, a tongue 12 is provided at the toner reservoir TV and a groove 13 is provided at the cover DE. Furthermore, the region of the cover DE is executed with a gradient as a run-in slope 14 around the groove 13, and in fact towards the groove 13. If the cover DE is rotated in order to be screwed down, the tongue 12 runs over the run-in slope 14, thereby elastically deforms and finally snaps into the groove 13, wherein the tongue 12 relaxes again. At the end of the rotation, the thread sectors 10, 11 are firmly compressed with one another and the tongue 12 is in the groove 13. An opening of the toner reservoir TV during transport is then not possible without destruction.

Figure 6:
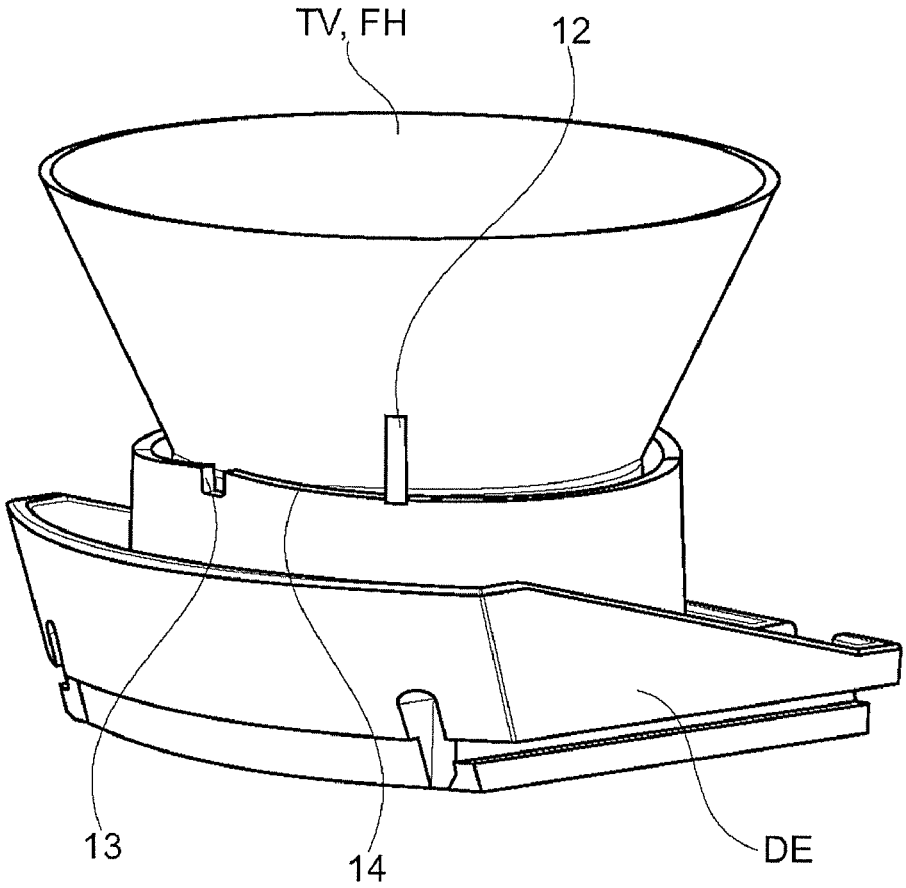
FIGS. 6 and 7 are views of the second embodiment at successive rotation positions of a cover.
Figure 7:
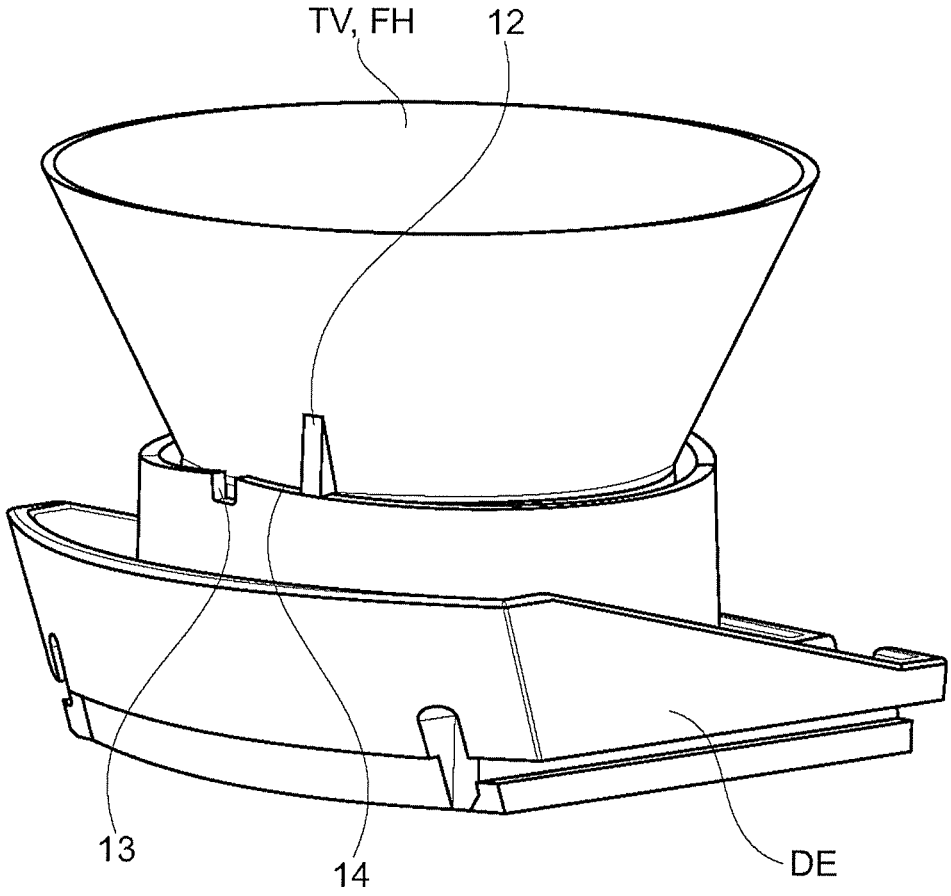
Figure 8:
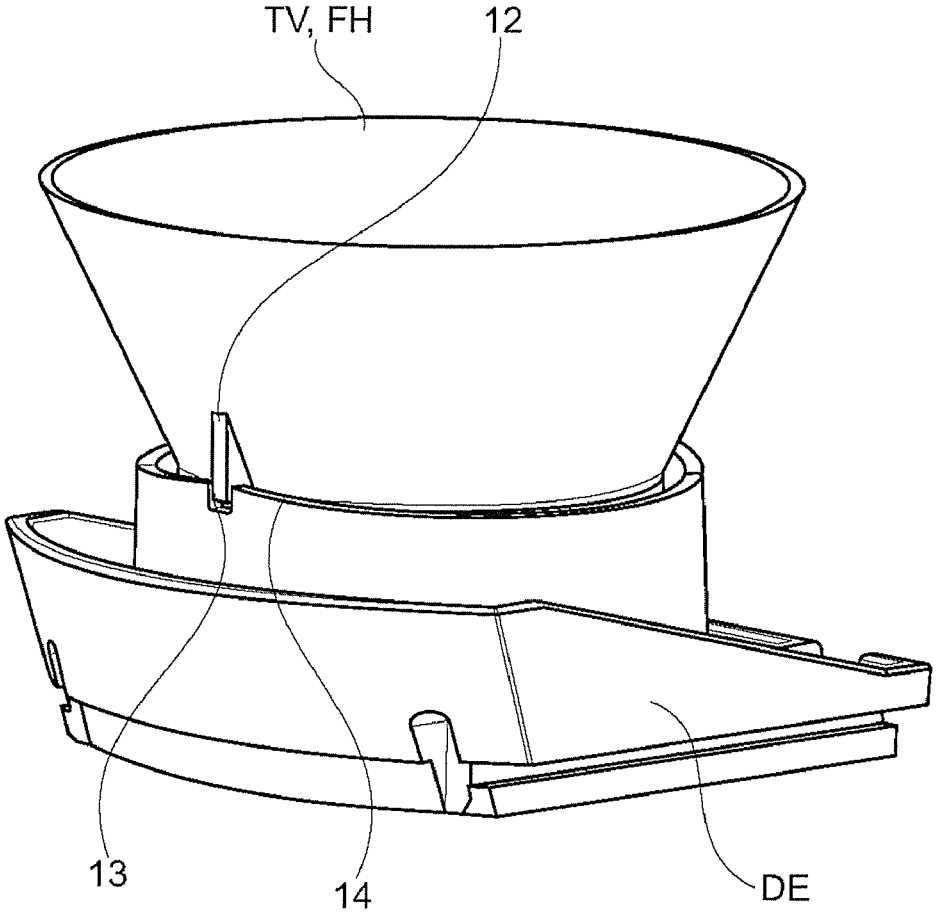
FIG. 8 is a view of cover and toner reservoir after engagement of a tongue in a groove.

FIG. 6 shows the position of the cover DE at the toner reservoir TV when, upon rotation, the tongue 12 arrives at the beginning of the run-in slope 14. This state exists when, for example, the cover DE has been placed on the toner reservoir TV. In FIG. 7, the case is shown when, upon rotation, the tongue 12 slides onto the run-in slope 14. FIG. 8 then shows the end state in the locking, for example after a rotation by 45° in which the tongue 12 is engaged in the groove 13 and the thread sectors 10, 11 are pressed together with one another. Multiple tongues 12 and a corresponding number of grooves 13 can also be provided.

To establish the locking connection, the cover DE is placed on the toner reservoir TV such that the thread sectors 10 come to lie between the thread sectors 11. The cover DE is subsequently rotated, the thread sectors 10, 11 are thereby screwed down and the tongue 12 runs on the run-in slope 14 in the direction of the groove 13. At the end of the rotation movement, the tongue 12 engages in the groove 13; the thread sectors 10, 11 are thereby firmly screwed together with one another. An unscrewing of the cover DE would then only be possible if the tongue 12 were destroyed, for example.

Figure 9:
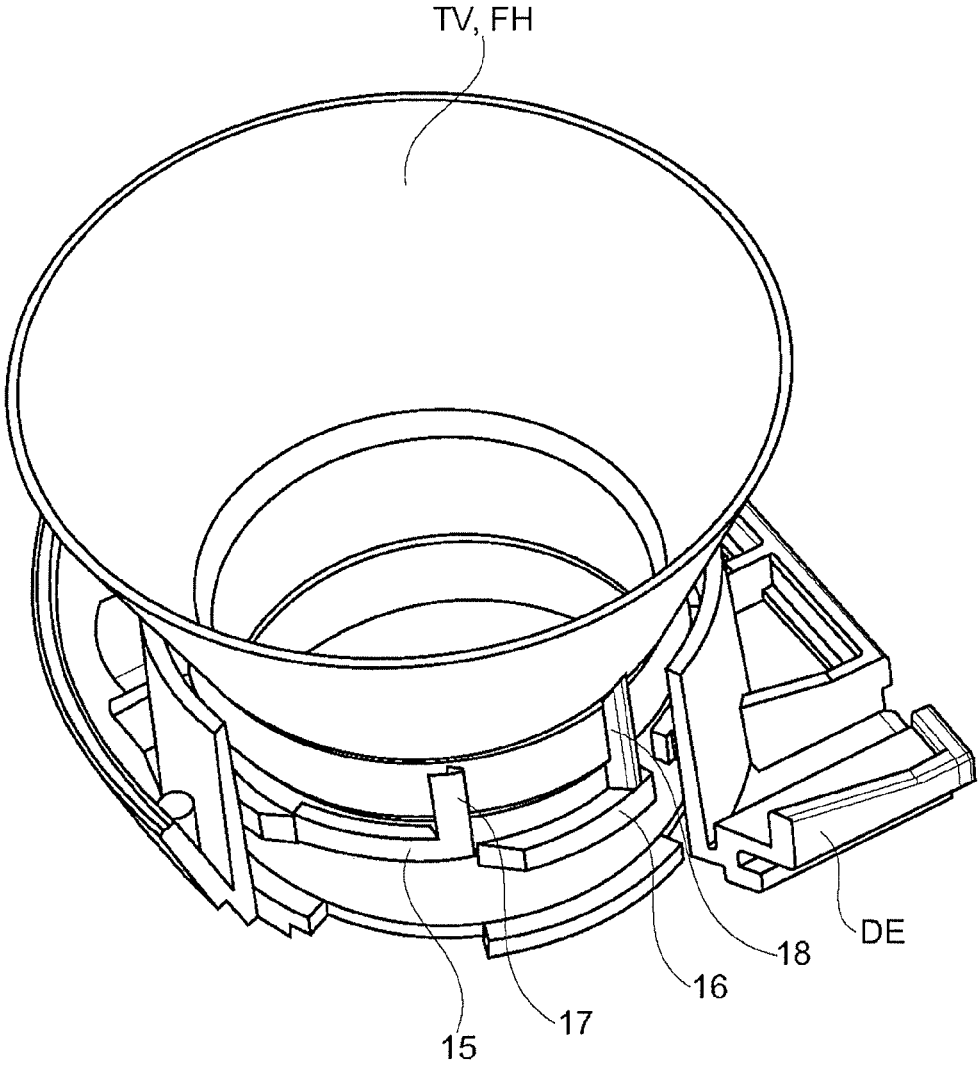
FIGS. 9 through 13 show views of cover and toner reservoir at successive rotation positions of cover relative to toner reservoir in a third embodiment.

A third solution of the posed problem arises from FIG. 9. FIG. 9 shows the cover DE on whose inner side first thread sectors 15 are again arranged as a first locking unit, for example four first thread sectors 15. In contrast to FIG. 5, however, a catch angle 17 is arranged at the end of every first thread sector 15, and in fact perpendicular to the first thread sector 15 and at a distance from the cover DE. FIG. 9 furthermore shows the toner reservoir TV that has a second thread sector 16 on the outside as a second locking unit, the parallel end of which second thread sector 16 ends in a catch step 18. The catch angle 17 continues the first thread sector 15 and is arranged on the outside of the first thread sector 15.

To brace cover DE with toner reservoir TV, the cover DE is again set on the toner reservoir TV so that the first thread sectors 15 of the cover DE come to lie between the second thread sectors 16 of the toner reservoir TV (FIG. 9). If the cover DE is then rotated relative to the toner reservoir TV, the two thread sectors 15, 16 initially screw down. At the end of the rotation movement, the catch angle 17 (which is executed so as to be elastic) slides over the catch step 18 and elastically folds over the catch step 18. The two thread sectors 15, 16 are then pressed together and the rotation movement in the opposite direction is prevented via the locking of catch angle 17 and catch step 18.

Figure 10:
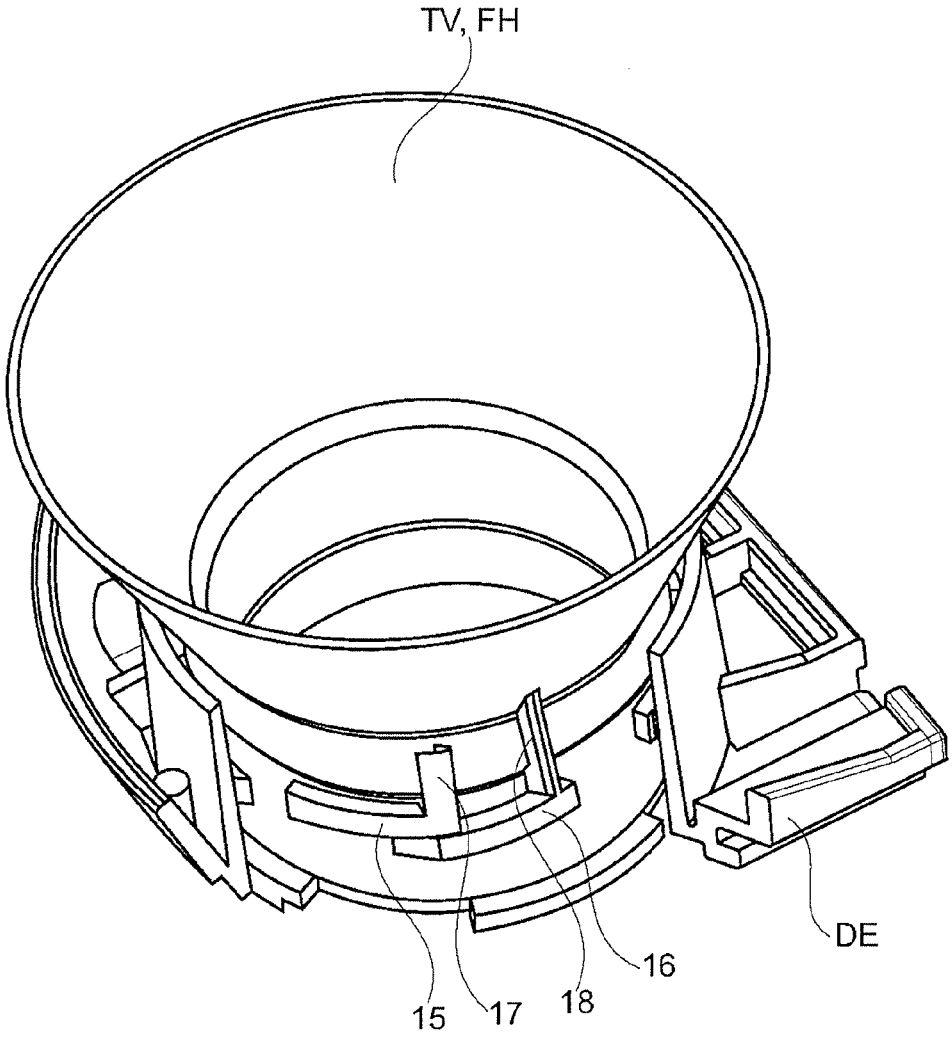
Figure 11:
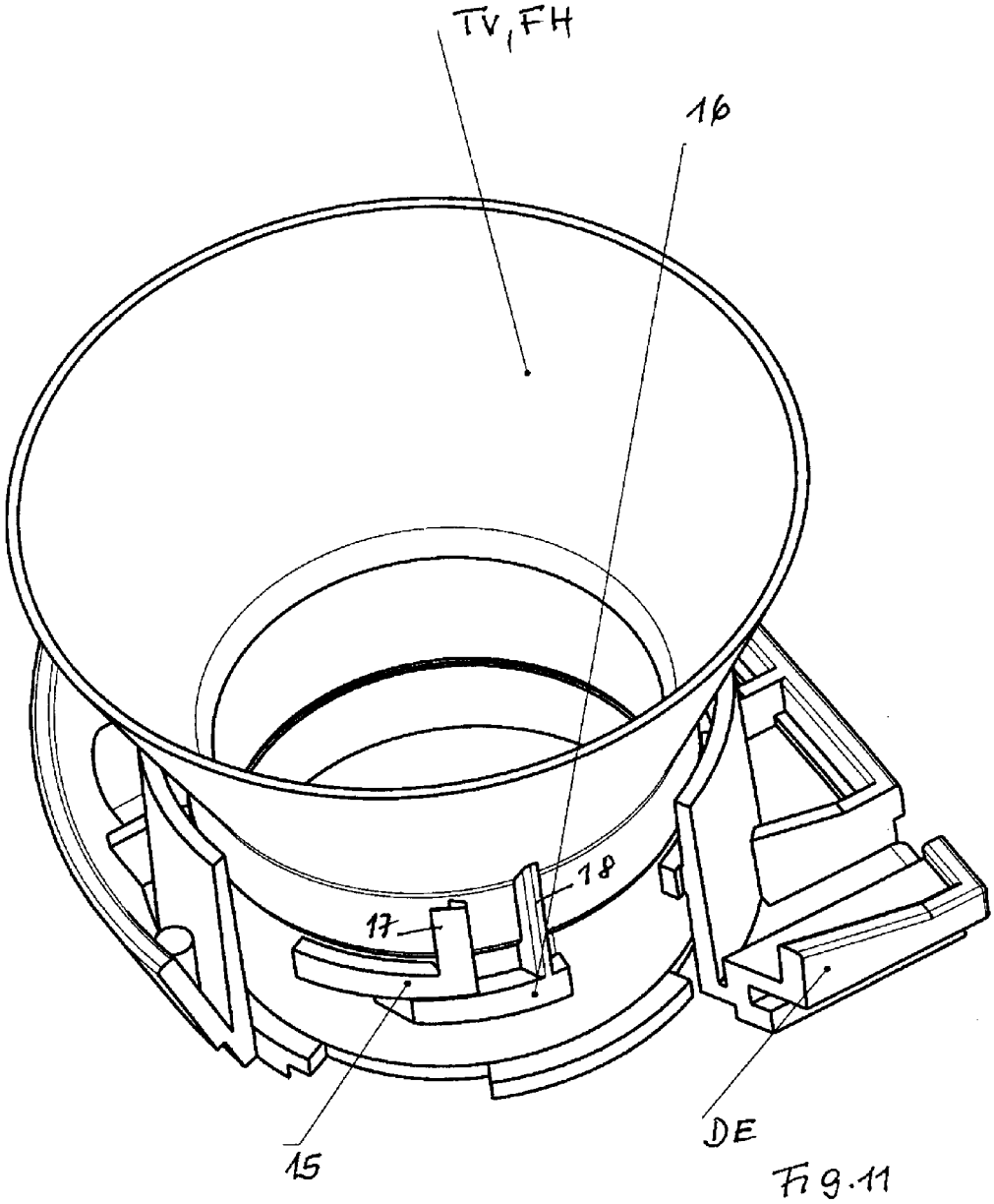
Figure 12:
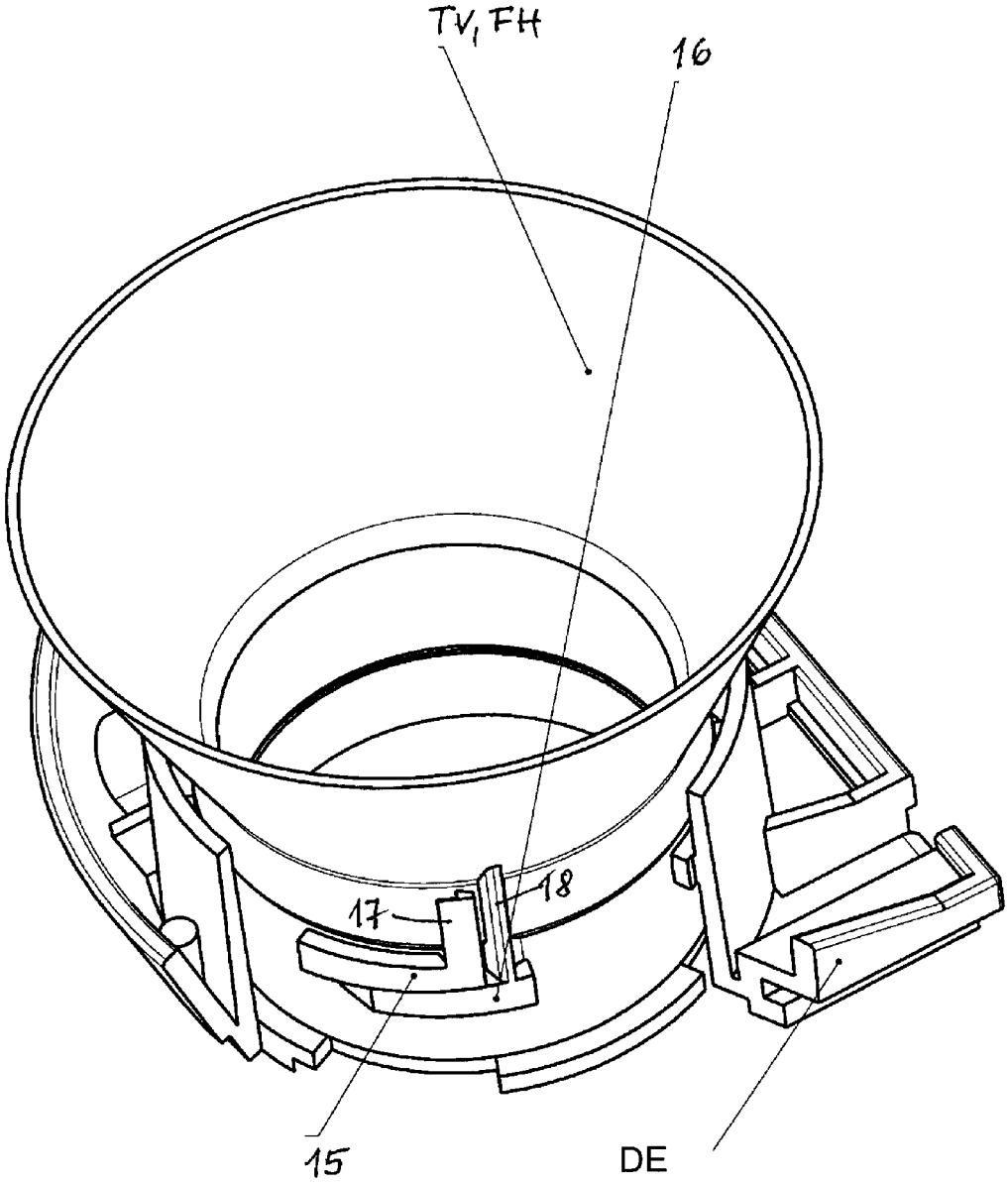
Figure 13:
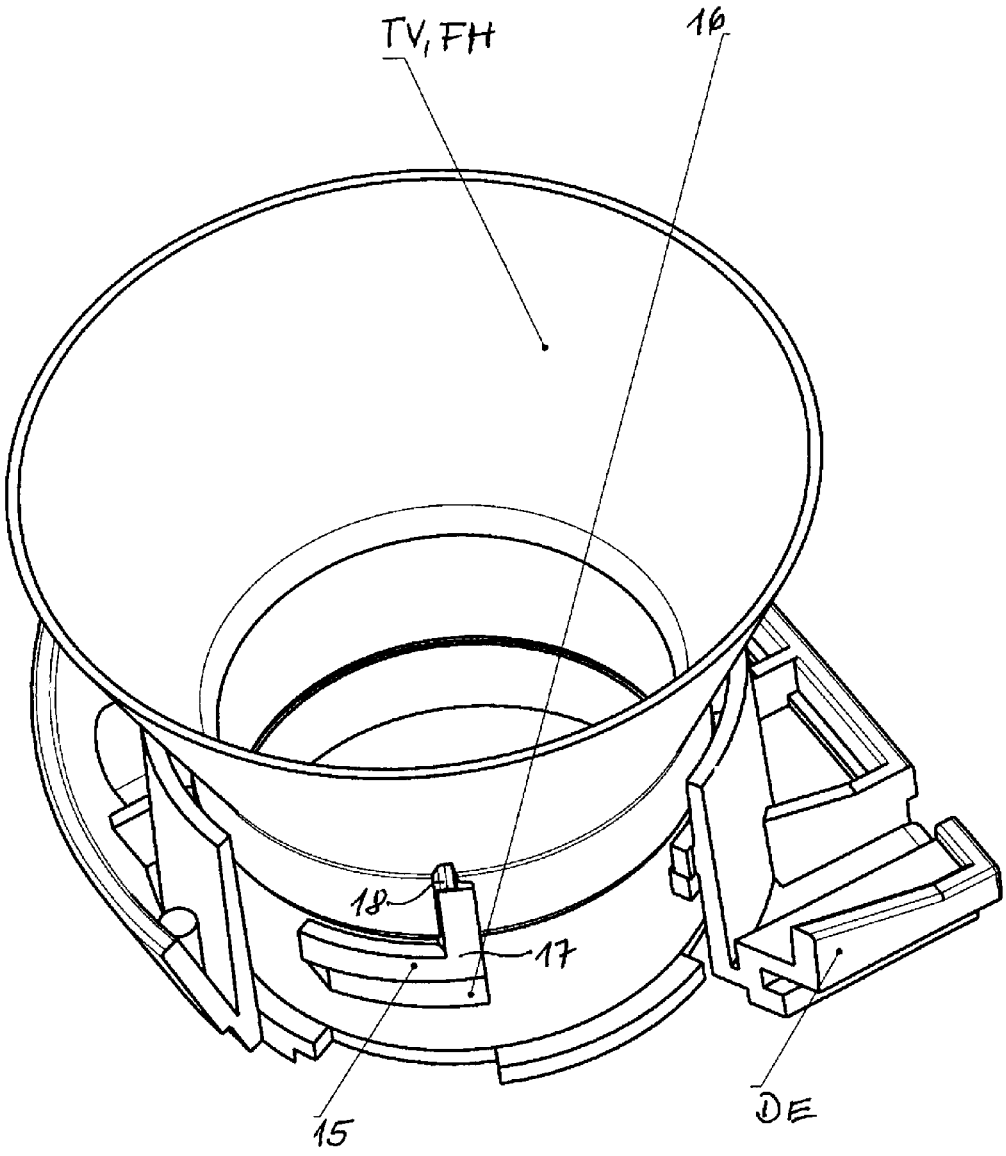
Figure 14:
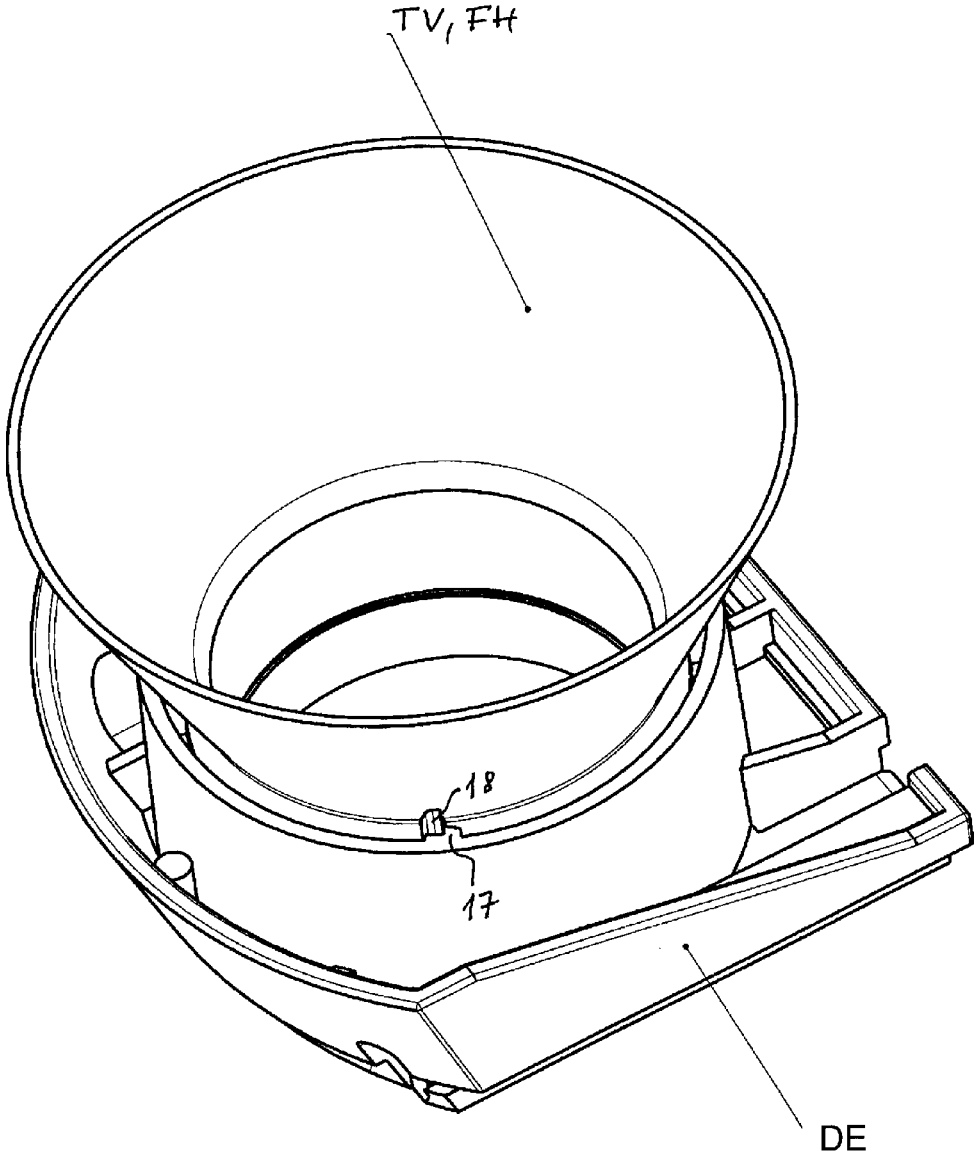
FIG. 14 is a view of cover and toner reservoir after establishing a locking connection.

The workflow of the locking of the third embodiment is shown in FIGS. 9 through 13. FIG. 9 shows the arrangement of cover DE relative to toner reservoir TV at the point in time of the placement. The two thread sectors 15, 16 lie next to one another. FIGS. 10 and 11 show the position of the thread sectors 15, 16 relative to one another during the rotation process, in chronological succession. The position of the thread sectors 15, 16 just before the catch angle 17 slides over the catch step 18 is shown in FIG. 12. FIG. 13 then shows this. Here the catch angle 17 has slid over the catch step 18 and is engaged on this. An unscrewing of the cover DE is now no longer possible. One advantage of this solution is that an external intrusion into the lock connection is not possible, as this is shown by FIG. 14.

In the third solution it is not necessary that a tongue and a groove are provided as in the first two solutions, since here the lock connection is secured by the catch angle 17 and the catch step 18.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A system to produce a locking connection between a toner reservoir and a cover sealing the toner reservoir, comprising:

first and second locking units that are locked with one another after sealing the toner reservoir with the cover;

the first locking unit being arranged on an inside of the cover;

the second locking unit being arranged on an outside of the toner reservoir; and at least one of the first and second locking units having a run-in slope over which the other locking unit slides upon closing of the toner reservoir via the cover, and wherein the run-in slope is shaped such that the sliding of the other locking unit on the one locking unit occurs only with the use of force.

2. A system according to claim 1 in which at least two rigid hooks arranged offset from one another are provided as the first locking unit, a respective head of the hook respectively has the run-in slope aligned towards the toner reservoir and falls away towards a head end of the hook.

3. A system according to claim 2 in which the second locking unit is arranged as ring sectors at the toner reservoir, a number of said ring sectors corresponding to a number of the hooks.

4. A system according to claim 3 in which the ring sectors are elastic so that, upon sealing the toner reservoir with the cover, the hooks with their run-in slopes slide over the ring sectors, said ring sectors thereby deforming elastically until the hooks with their hook heads engage with the ring sectors, wherein the ring sectors relax again after the engagement.

5. A system according to claim 3 in which the toner reservoir is elastic in regions so that the hooks elastically deform the toner reservoir upon sliding on the ring sectors, and wherein the toner reservoir relaxes again after the engagement.

6. A system according to claim 3 in which the ring sectors have a run-in slope parallel with the run-in slope of the hooks, and over said run-in slope of the ring sectors the hooks slide to lock.

7. A system according to claim 3 in which an edge of the cover has at least one groove, at least one tongue is arranged at an edge of the toner reservoir, a run-in slope rising towards the groove is provided on at least one side of the groove on the cover, the tongue and the groove are arranged relative to one another such that the tongue slides over the cover run-in slope upon rotation of the cover relative to the toner reservoir, the tongue elastically deforming and the tongue engaging in the groove at an end of the rotation and relaxes again, and the ring sectors are provided sufficiently wide so that the hook head remains engaged on the ring sector during the rotation of the cover to engage the tongue in the groove.

8. A system according to claim 2 in which ends of the hook heads are blunt.

9. A system according to claim 1 in which a screw connection formed of thread sectors is provided, wherein at least one first thread sector is provided as said first locking unit and at least one second thread sector is provided as said second locking unit, the first and second locking units being arranged such that the one thread sector slides under the other thread sector upon rotation of the cover relative to the toner reservoir, and the thread sectors are arranged such that both thread sectors compress with one another upon rotation of the cover.

10. A system according to claim 9 in which an edge of the cover has at least one groove, at least one tongue is arranged at an edge of the toner reservoir, a run-in slope rising towards the groove is provided on at least one side of the groove at the cover, and the tongue and the groove are arranged relative to one another such that the tongue slides over the cover run-in slope upon rotation of the cover relative to the toner reservoir to screw it down, wherein the tongue elastically deforms, and the tongue engages in the groove at an end of the rotation and relaxes again.

11. A system according to claim 9 in which the first locking unit at the cover has at least one first thread sector that at one end has a catch angle situated at a distance from the cover and perpendicular to the first thread sector.

12. A system according to claim 11 in which the second locking unit at the toner reservoir has at least one second thread sector that has at one end a catch step situated perpendicular to the second thread sector.

13. A system according to claim 12 in which upon rotation a rotation path of the cover relative to the toner reservoir is selected so that the first thread sector slides under the second thread sector until the catch angle slides over the catch step and engages at the catch step.

14. A method to produce a locking connection between a toner reservoir and a cover sealing the toner reservoir, comprising the steps of:

providing first and second locking units locked with one another after sealing the toner reservoir with the cover, the first locking unit being arranged on an inside of the cover and the second locking unit being arranged on an outside of the toner reservoir, at least one of the two locking units having a run-in slope, and wherein the first locking unit comprises at least two rigid hooks each of which has a run-in slope at a head of the respective hook and which falls away toward a head end of the hook, and wherein the second locking unit comprises ring sectors at the toner reservoir, a number of said ring sectors corresponding to a number of said hooks, wherein an edge of the cover has at least one groove, and at least one tongue is arranged at an edge of the toner reservoir, and a run-in slope rising towards the groove on at least one side of the groove on the cover edge;

placing the cover on the toner reservoir such that the hooks slide over the ring sectors until the hook head of the hooks engage at the ring sectors; and subsequently rotating the cover until the tongue on the toner reservoir engages in the groove at the edge of the cover.

15. A method to produce a locking connection between a toner reservoir and a cover sealing a toner reservoir, comprising the steps of:

providing first and second locking units that are locked with one another after sealing the toner reservoir with the cover, the first locking unit being arranged on an inside of the cover and the second locking unit being arranged on an outside of the toner reservoir, wherein a screw connection formed of thread sectors is provided wherein said first locking unit comprises at least one first thread sector and said second locking unit comprises at least one second thread sector, the thread sectors being arranged such that the one thread sector slides under the other thread sector upon rotation of the cover relative to the toner reservoir, the thread sectors being arranged such that both thread sectors are compressed against one another upon rotation of the cover, and an edge of the cover having at least one groove and at least one tongue arranged at an edge of the toner reservoir, and a run-in slope rising towards the groove provided on at least one side of the groove at the edge of the cover;

placing the cover on the toner reservoir such that the first thread sectors lie between the second thread sectors;

rotating the cover so that the first and second thread sectors screw down with one another; and ending the rotation movement of the cover relative to the toner reservoir via engagement of the tongue arranged on the toner reservoir in the groove arranged on the cover.

16. A method to produce a locking connection between a toner reservoir and a cover sealing the toner reservoir, comprising the steps of:

providing first and second locking units that are locked with one another after sealing the toner reservoir with the cover, the first locking unit being arranged on an inside of the cover and the second locking unit being arranged on an outside of the toner reservoir, the first locking unit comprising at least one first thread sector that at one end has a catch angle perpendicular to the first thread sector, the second locking unit comprising at least one second thread sector having at one end a catch step situated perpendicular to the second thread sector;

placing the cover on the toner reservoir such that the first thread sectors come to lie between the second thread sectors;

rotating the cover so that the first and second thread sectors screw down with one another; and ending the rotation movement of the cover relative to the toner reservoir via engagement of the catch angle arranged on the first thread sector and the catch step arranged on the second thread sector.

* * * * *